US005929356A

United States Patent [19]

Piland et al.

[11] Patent Number: 5,929,356

[45] Date of Patent: Jul. 27, 1999

[54] MALLET FOR A MUSICAL INSTRUMENT

[75] Inventors: Evan R Piland, Stow, Ohio; George F. Jacob, Quinton, Va.

[73] Assignee: American Drum, Inc., Richmond, Va.

[21] Appl. No.: 08/896,962

[22] Filed: Jul. 18, 1997

[51] Int. Cl.[6] ..... G10D 3/00

[52] U.S. Cl. ..... 84/422.4; 84/452 P

[58] Field of Search ..... 84/422.4, 452 P

[56] References Cited

U.S. PATENT DOCUMENTS 1,472,397 10/1923 Leedy .
1,810,731 6/1931 Roark .
2,586,163 2/1952 Heiderich et al. .
3,608,419 9/1971 Russell .
3,998,123 12/1976 Hinger .
4,541,322 9/1985 Calato .
4,632,006 12/1986 Ambroszewski ..... 84/422 S
4,640,177 2/1987 Elliott, Jr. .
4,649,792 3/1987 Swartzlander .

*Primary Examiner*—William M. Shoop, Jr.
*Assistant Examiner*—Kim Lockett
*Attorney, Agent, or Firm*—Miller, White, Zelano, & Branigan, P.C.

[57] ABSTRACT

A musical tool for striking an instrument comprises a shaft and a head connected to one end of the shaft. A layer of short fibers is adhered to the surface of the head. The short fibers have inner and outer ends, the inner end adhered to the head and the outer end projecting outwardly from the head in a direction generally normal to the point of adherence.

4 Claims, 1 Drawing Sheet

MALLET FOR A MUSICAL INSTRUMENT

BACKGROUND OF THE INVENTION

This invention relates to durable mallets for musical instruments. The invention may be used with a wide variety of instruments including percussion instruments such as drums and bells and also string instruments such as the piano.

Prior art mallets generally comprise a shaft including one end which makes up a handle and the other end which is the head. The head end may have a mallet head secured to it. One of these types of mallet head, mallet heads for bass drum or timp-toms, has traditionally been constructed of solid felt shaped generally in the form of a cylinder. A problem with these types of mallets is that the mallet heads are formed of felt and tend to become softened or mushy after a certain amount of use. Also, the mallet head may get wet, for instance, when a marching band is caught in a rain storm, and this accelerates the deterioration of the felt head. This causes the sound produced by the mallet to lack proper texture and to be muffled which is undesirable. Felt also swells and may mildew. The mallets must therefore be replaced periodically, which is particularly undesirable in view of the expense of felt mallets.

In order to overcome the lack of durability of felt mallet heads, mallets having rubber heads have been used. While these rubber heads display excellent durability, the sound and feel of these mallets is not desirable for all users. Specifically, a drummer may not like the bounce of the rubber head off the head of the drum, or a rubber head can "grip" the head of the drum. Rubber abrasion may also wear out drum heads. Similarly, the sound produced by a rubber head is not always pleasing to a listener.

Still a further type of prior art mallet head is constructed of wood or rubber that includes a covering of wool or synthetic yarn. Disadvantages of such mallets include the high cost of manufacturing and the limited life of the mallet heads. It is therefore desired to provide a mallet which is relatively inexpensive to manufacture yet is still very durable.

SUMMARY OF THE INVENTION

The present invention is a musical tool for striking an instrument that comprises a shaft and a head connected to one end of the shaft and a layer of short fibers that is adhered to the surface of the head. The head may be made of many different types of materials. Two preferred types of materials include rubber and plastic. The short fibers have inner and outer ends, the inner end adhered to the head and the outer end projecting outwardly from the head in a direction generally normal to the point of adherence. The short fibers themselves may have variable lengths or they may be generally uniform in length.

The invention also includes a drum mallet comprising a shaft and a rubber head connected to the end of a shaft. A layer of short fibers is adhered to the surface of the rubber head. Each of the short fibers has an inner and outer end, the inner end adhered to the head, the outer end projecting outwardly from the head in a direction generally normal to the point of adherence.

Another embodiment of the invention is a stick for striking the head of a drum comprising a first end for coming into contact with the drum and a second end adapted to be a handle. The first end further comprises a bead wherein the bead is coated with a layer of fibers adhered to the surface of the bead. Each of the short fibers has an inner and outer end, the inner end adhered to the bead, the outer end projecting outwardly from the bead in a direction generally normal to the point of adherence.

DETAILED DESCRIPTION OF A PREFERRED EMBODIMENT

Figure 1:
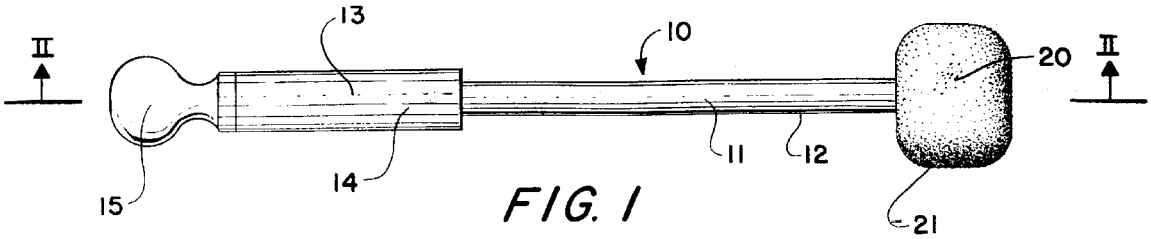
FIG. 1 is a side view of a drum mallet displaying a preferred embodiment of the present invention.

Turning now to FIG. 1, there is seen a drum mallet 10 displaying one of the preferred embodiments of the present invention. The mallet 10 is made up of a shaft 11 having a first end 12 and a second end 13. Mounted about the second end 13 of the shaft 11 is a grip 14 that is made up of a rubber or vinyl material that forms a comfortable cushion for a musician handling the mallet 10. Also attached to the second end 13 of the shaft 11 is a finial 15 that is an additional grip for a musician using the mallet 10.

Mounted about the first end 12 of the shaft 11 is a mallet head 20. The mallet head 20 is generally cylindrical in shape with radiused edges. The mallet head 20 is coated with a layer of short fibers 21 commonly referred to as flocking. The fibers 21 are adhered to the rubber head 20. The fibers 21 give the head the performance and feel characteristics of felt.

Figure 2:
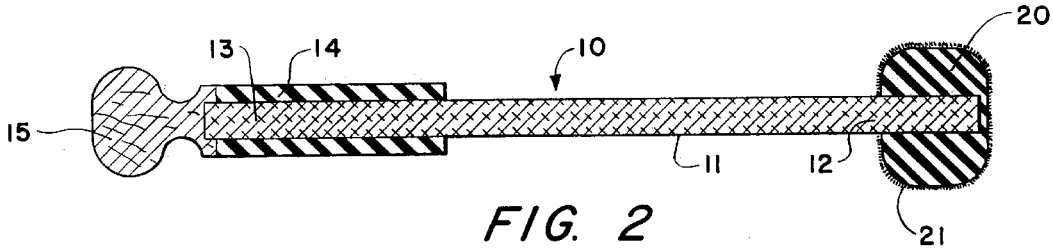
FIG. 2 is a sectional, side view of the drum mallet illustrated in FIG. 1, taken along the line II—II thereof

FIG. 2 is a sectional view of FIG. 1 taken along line II—II thereof. The finial 15 is shown attached to the second end 13 of the shaft 11. The grip 14 is shown disposed about the circumference of the second end 13 of the shaft 11. The rubber head 20 is shown disposed about the first end 12 of the shaft 11. The grip 14 and the finial 15 are mounted onto the shaft 11 by press-fitting them onto the shaft. The resulting interference fit keeps them permanently secure. Adhesives may alternatively be used to reinforce the interference fit. The rubber head 20 may be adhered directly to the shaft 11 using a permanent adhesive. Preferably, a plastic insert (not shown), also called a thimble, is permanently adhered to the inside of the rubber head 20. The shaft 11 is then press-fit into the insert to secure the shaft to the rubber head 20.

Figure 3:
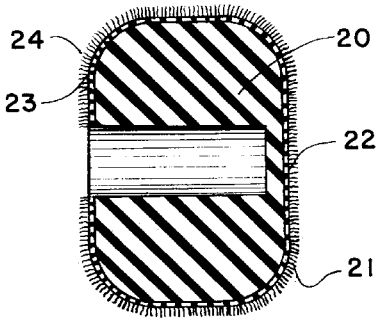
FIG. 3 is an enlarged, sectional view of the mallet head displaying a preferred embodiment of the present invention.

FIG. 3 displays a close-up of the rubber head 20 that is mounted around the first end 12 of the shaft. Adhesive 22 is layered about the surface of the rubber head 20. Adhered all about the outside surface of the rubber head 20 are the short fibers 21 also referred to as flocking material. These fibers 21 are very fine, flexible, closely packed, relatively short nylon fibers which project outwardly from the surface of the rubber head 20. The inner ends 23 of each of the fibers 21 are bonded to the rubber head 20 whereby the fibers form a thick soft pile to provide a velvet-like seamless coating covering the head. The outer ends 24 of the fibers project outwardly in a direction substantially normal to the surface of the rubber head. This velvet-like coating is extremely durable and gives the musician the feel of solid felt as well as the acoustic sound of solid felt. If desired, the fibers 21 may be provided in various colors to produce a decorative appearance and/or the fibers may incorporate a suitable florescent material which will fluoresce under natural or ultraviolet lighting conditions so as to provide novel general effects for viewers thereof. Similarly, the length of the fibers 21 may be generally uniform or they may have variable lengths depending on the sounds desired to be made.

Figure 4:
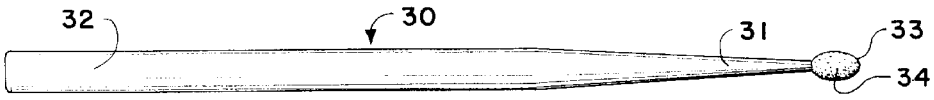
FIG. 4 is a side view of a drumstick displaying an alternative embodiment of the present invention.

FIG. 4 displays a drumstick 30 having a first end 31 and a second end 32. The first end 31 includes the bead 34 of the drumstick 30 as shown and is coated with a layer of short fibers 33, to give a different tone to the sound generated when the bead of the drumstick strikes a drum. The second end 32 is the butt or handle of the drumstick 30.

When manufacturing the head 20 of a mallet 10 or the first end 31 of a drumstick 30, the head or bead is initially formed to the desired shape. The head 20 or bead 34 is then coated with a thin layer 22 of a suitable bonding material, and the very fine, flexible, relatively short nylon fibers 21 and 33 are preferably applied through the agency of a conventional electrostatic applicator which electrostatically propels the very fine nylon fibers actually onto the head or the bead so that the fibers project outwardly from the surface in a direction substantially normal or perpendicular to such surface. The inner ends of each of the fibers are bonded to the head or tip by the adhesive layer of adhesive 22 with the fibers being closely and densely packed, substantially erect and in the form of a big soft pile whereby the fibers form a velvet-like seamless surface.

By way of example, the nylon fibers may have the dimensions in the range of about denier 1.5 (thickness) and length 0.020" up to about denier 20 (thickness) and length 0.080". The short fibers themselves may be made from nylon, polyester, rayon, acrylic or other synthetic and natural materials. Standard types of adhesives used include solvent borne adhesive for rubber surfaces (available from Lord Corporation) and acrylic aqueous emulsion for most plastics (e.g., ABS, propylene) (available from B.F. Goodrich). In selecting the specific fiber composition, the coefficient of friction with the musical instrument surface must be factored in. For instance, soft fibers may "grip" to a drum head and give unacceptable acoustical results. The coefficient of friction with a drum head may be varied by a manufacturer to match that of felt. Of course, variations may be desired for specifically desired acoustical results.

The head 20 disclosed in FIGS. 1 through 3 is made of a natural rubber material. It may also be comprised of other materials including, for instance, another type of rubber, wood, plastic, metal or composites. Rubber is the preferred composition because, when coated, it can give a comparable tone to conventional felt mallet heads. The tone coming from the rubber head can be modified by the selection of rubber polymer and hardness. It is advantageous that whatever material is chosen, it should be waterproof like rubber. If the composition is not affected by moisture, it will be more durable.

In addition to drum mallet heads and drumstick beads, the invention may be used in connection with any musical instrument that is or may be struck by a similar tool. For instance, the hammers found in pianos may be manufactured according to the present invention whereby a core material is covered with short fibers. The result is a more durable and long-lasting hammer than the traditional solid felt piano hammer.

While this invention has been described as having preferred designs, it will be understood that it is capable of further modification. This application is therefore intended to cover any variations, uses or adaptations of the invention following the general principles thereof and including such departure from the present disclosure as come within known or customary practice in the art.

That which is claimed is:

1. A musical tool for striking an instrument comprising a shaft and a head connected to an end of the shaft, wherein a layer of short fibers is adhered to the surface of the head, each of the short fibers having an inner end and outer end, the inner end adhered to the head, the outer end projecting outwardly from the head in a direction generally normal to the point of adherence.

2. A drum mallet comprising a shaft and a rubber head connected to an end of the shaft, wherein a layer of short fibers is adhered to the surface of the rubber head, each of the short fibers having an inner end and outer end, the inner end adhered to the head, the outer end projecting outwardly from the head in a direction generally normal to the point of adherence.

3. A stick for striking the head of a drum comprising a first end and for coming into contact with the drum and further comprising a plastic bead wherein the bead is coated with a layer of fibers adhered to the surface of the bead, and a second end adapted to be a handle.

4. A stick for striking the head of a drum comprising a first end for coming into contact with the drum and further comprising a bead wherein the bead is coated with a layer of fibers adhered to the surface of the bead, and a second end adapted to be a handle, further wherein each of the short fibers has an inner end and outer end, the inner end adhered to the bead, the outer end projecting outwardly from the bead in a direction generally normal to the point of adherence.

* * * * *